US008681064B2

(12) United States Patent
Isom

(10) Patent No.: US 8,681,064 B2
(45) Date of Patent: Mar. 25, 2014

(54) RESISTIVE FREQUENCY SELECTIVE SURFACE CIRCUIT FOR REDUCING COUPLING AND ELECTROMAGNETIC INTERFERENCE IN RADAR ANTENNA ARRAYS

(75) Inventor: Robert S. Isom, Allen, TX (US)

(73) Assignee: Raytheon Company, Waltham, MA (US)

( * ) Notice: Subject to any disclaimer, the term of this patent is extended or adjusted under 35 U.S.C. 154(b) by 537 days.

(21) Appl. No.: 12/968,147

(22) Filed: Dec. 14, 2010

(65) Prior Publication Data

US 2012/0154232 A1 Jun. 21, 2012

(51) Int. Cl.
*H01Q 19/06* (2006.01)

(52) U.S. Cl.
USPC ..... 343/753; 343/872; 343/909

(58) Field of Classification Search
USPC ..... 343/753, 872, 909
See application file for complete search history.

(56) References Cited

U.S. PATENT DOCUMENTS

| | | | | |
|---|---|---|---|---|
| 5,471,224 | A * | 11/1995 | Barkeshli | 343/909 |
| 5,949,387 | A * | 9/1999 | Wu et al. | 343/909 |
| 6,836,258 | B2 * | 12/2004 | Best et al. | 343/909 |
| 7,612,718 | B2 | 11/2009 | Sievenpiper | |
| 7,639,206 | B2 | 12/2009 | Behdad | |
| 7,679,563 | B2 | 3/2010 | Werner et al. | |

* cited by examiner

*Primary Examiner* — Tan Ho
(74) *Attorney, Agent, or Firm* — Christie, Parker & Hale, LLP

(57) ABSTRACT

An antenna system for reducing unwanted coupling and electromagnetic interference, the antenna system including a transmit module configured to send a signal, a receive module configured to receive the signal, a radome, and a resistive frequency selective surface circuit configured to reduce a coupled portion of the signal, the resistive frequency selective surface circuit disposed in a path of the coupled portion of the signal.

21 Claims, 6 Drawing Sheets

*FIG.1*

| | | 1 | 2 | 3 | 4 | 5 | 6 | 7 | 8 | 9 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 |
|---|---|---|---|---|---|---|---|---|---|---|---|---|---|---|---|---|---|---|---|---|---|---|---|---|---|---|---|---|---|---|---|---|---|
| 32 | 16 | 31 | 63 | 95 | 127 | 159 | 191 | 223 | 255 | 287 | 319 | 351 | 383 | 415 | 447 | 479 | 511 | 543 | 575 | 607 | 639 | 671 | 703 | 735 | 767 | 799 | 831 | 863 | 895 | 927 | 959 | 991 | 1023 |
| 31 | 15 | 30 | 62 | 94 | 126 | 158 | 190 | 222 | 254 | 286 | 318 | 350 | 382 | 414 | 446 | 478 | 510 | 542 | 574 | 606 | 638 | 670 | 702 | 734 | 766 | 798 | 830 | 862 | 894 | 926 | 958 | 990 | 1022 |
| 30 | 14 | 29 | 61 | 93 | 125 | 157 | 189 | 221 | 253 | 285 | 317 | 349 | 381 | 413 | 445 | 477 | 509 | 541 | 573 | 605 | 637 | 669 | 701 | 733 | 765 | 797 | 829 | 861 | 893 | 925 | 957 | 989 | 1021 |
| 29 | 13 | 28 | 60 | 92 | 124 | 156 | 188 | 220 | 252 | 284 | 316 | 348 | 380 | 412 | 444 | 476 | 508 | 540 | 572 | 604 | 636 | 668 | 700 | 732 | 764 | 796 | 828 | 860 | 892 | 924 | 956 | 988 | 1020 |
| 28 | 12 | 27 | 59 | 91 | 123 | 155 | 187 | 219 | 251 | 283 | 315 | 347 | 379 | 411 | 443 | 475 | 507 | 539 | 571 | 603 | 635 | 667 | 699 | 731 | 763 | 795 | 827 | 859 | 891 | 923 | 955 | 987 | 1019 |
| 27 | 11 | 26 | 58 | 90 | 122 | 154 | 186 | 218 | 250 | 282 | 314 | 346 | 378 | 410 | 442 | 474 | 506 | 538 | 570 | 602 | 634 | 666 | 698 | 730 | 762 | 794 | 826 | 858 | 890 | 922 | 954 | 986 | 1018 |
| 26 | 10 | 25 | 57 | 89 | 121 | 153 | 185 | 217 | 249 | 281 | 313 | 345 | 377 | 409 | 441 | 473 | 505 | 537 | 569 | 601 | 633 | 665 | 697 | 729 | 761 | 793 | 825 | 857 | 889 | 921 | 953 | 985 | 1017 |
| 25 | 9 | 24 | 56 | 88 | 120 | 152 | 184 | 216 | 248 | 280 | 312 | 344 | 376 | 408 | 440 | 472 | 504 | 536 | 568 | 600 | 632 | 664 | 696 | 728 | 760 | 792 | 824 | 856 | 888 | 920 | 952 | 984 | 1016 |
| 24 | 8 | 23 | 55 | 87 | 119 | 151 | 183 | 215 | 247 | 279 | 311 | 343 | 375 | 407 | 439 | 471 | 503 | 535 | 567 | 599 | 631 | 663 | 695 | 727 | 759 | 791 | 823 | 855 | 887 | 919 | 951 | 983 | 1015 |
| 23 | 7 | 22 | 54 | 86 | 118 | 150 | 182 | 214 | 246 | 278 | 310 | 342 | 374 | 406 | 438 | 470 | 502 | 534 | 566 | 598 | 630 | 662 | 694 | 726 | 758 | 790 | 822 | 854 | 886 | 918 | 950 | 982 | 1014 |
| 22 | 6 | 21 | 53 | 85 | 117 | 149 | 181 | 213 | 245 | 277 | 309 | 341 | 373 | 405 | 437 | 469 | 501 | 533 | 565 | 597 | 629 | 661 | 693 | 725 | 757 | 789 | 821 | 853 | 885 | 917 | 949 | 981 | 1013 |
| 21 | 5 | 20 | 52 | 84 | 116 | 148 | 180 | 212 | 244 | 276 | 308 | 340 | 372 | 404 | 436 | 468 | 500 | 532 | 564 | 596 | 628 | 660 | 692 | 724 | 756 | 788 | 820 | 852 | 884 | 916 | 948 | 980 | 1012 |
| 20 | 4 | 19 | 51 | 83 | 115 | 147 | 179 | 211 | 243 | 275 | 307 | 339 | 371 | 403 | 435 | 467 | 499 | 531 | 563 | 595 | 627 | 659 | 691 | 723 | 755 | 787 | 819 | 851 | 883 | 915 | 947 | 979 | 1011 |
| 19 | 3 | 18 | 50 | 82 | 114 | 146 | 178 | 210 | 242 | 274 | 306 | 338 | 370 | 402 | 434 | 466 | 498 | 530 | 562 | 594 | 626 | 658 | 690 | 722 | 754 | 786 | 818 | 850 | 882 | 914 | 946 | 978 | 1010 |
| 18 | 2 | 17 | 49 | 81 | 113 | 145 | 177 | 209 | 241 | 273 | 305 | 337 | 369 | 401 | 433 | 465 | 497 | 529 | 561 | 593 | 625 | 657 | 689 | 721 | 753 | 785 | 817 | 849 | 881 | 913 | 945 | 977 | 1009 |
| 17 | 1 | 16 | 48 | 80 | 112 | 144 | 176 | 208 | 240 | 272 | 304 | 336 | 368 | 400 | 432 | 464 | 496 | 528 | 560 | 592 | 624 | 656 | 688 | 720 | 752 | 784 | 816 | 848 | 880 | 912 | 944 | 976 | 1008 |
| 16 | 16 | 15 | 47 | 79 | 111 | 143 | 175 | 207 | 239 | 271 | 303 | 335 | 367 | 399 | 431 | 463 | 495 | 527 | 559 | 591 | 623 | 655 | 687 | 719 | 751 | 783 | 815 | 847 | 879 | 911 | 943 | 975 | 1007 |
| 15 | 15 | 14 | 46 | 78 | 110 | 142 | 174 | 206 | 238 | 270 | 302 | 334 | 366 | 398 | 430 | 462 | 494 | 526 | 558 | 590 | 622 | 654 | 686 | 718 | 750 | 782 | 814 | 846 | 878 | 910 | 942 | 974 | 1006 |
| 14 | 14 | 13 | 45 | 77 | 109 | 141 | 173 | 205 | 237 | 269 | 301 | 333 | 365 | 397 | 429 | 461 | 493 | 525 | 557 | 589 | 621 | 653 | 685 | 717 | 749 | 781 | 813 | 845 | 877 | 909 | 941 | 973 | 1005 |
| 13 | 13 | 12 | 44 | 76 | 108 | 140 | 172 | 204 | 236 | 268 | 300 | 332 | 364 | 396 | 428 | 460 | 492 | 524 | 556 | 588 | 620 | 652 | 684 | 716 | 748 | 780 | 812 | 844 | 876 | 908 | 940 | 972 | 1004 |
| 12 | 12 | 11 | 43 | 75 | 107 | 139 | 171 | 203 | 235 | 267 | 299 | 331 | 363 | 395 | 427 | 459 | 491 | 523 | 555 | 587 | 619 | 651 | 683 | 715 | 747 | 779 | 811 | 843 | 875 | 907 | 939 | 971 | 1003 |
| 11 | 11 | 10 | 42 | 74 | 106 | 138 | 170 | 202 | 234 | 266 | 298 | 330 | 362 | 394 | 426 | 458 | 490 | 522 | 554 | 586 | 618 | 650 | 682 | 714 | 746 | 778 | 810 | 842 | 874 | 906 | 938 | 970 | 1002 |
| 10 | 10 | 9 | 41 | 73 | 105 | 137 | 169 | 201 | 233 | 265 | 297 | 329 | 361 | 393 | 425 | 457 | 489 | 521 | 553 | 585 | 617 | 649 | 681 | 713 | 745 | 777 | 809 | 841 | 873 | 905 | 937 | 969 | 1001 |
| 9 | 9 | 8 | 40 | 72 | 104 | 136 | 168 | 200 | 232 | 264 | 296 | 328 | 360 | 392 | 424 | 456 | 488 | 520 | 552 | 584 | 616 | 648 | 680 | 712 | 744 | 776 | 808 | 840 | 872 | 904 | 936 | 968 | 1000 |
| 8 | 8 | 7 | 39 | 71 | 103 | 135 | 167 | 199 | 231 | 263 | 295 | 327 | 359 | 391 | 423 | 455 | 487 | 519 | 551 | 583 | 615 | 647 | 679 | 711 | 743 | 775 | 807 | 839 | 871 | 903 | 935 | 967 | 999 |
| 7 | 7 | 6 | 38 | 70 | 102 | 134 | 166 | 198 | 230 | 262 | 294 | 326 | 358 | 390 | 422 | 454 | 486 | 518 | 550 | 582 | 614 | 646 | 678 | 710 | 742 | 774 | 806 | 838 | 870 | 902 | 934 | 966 | 998 |
| 6 | 6 | 5 | 37 | 69 | 101 | 133 | 165 | 197 | 229 | 261 | 293 | 325 | 357 | 389 | 421 | 453 | 485 | 517 | 549 | 581 | 613 | 645 | 677 | 709 | 741 | 773 | 805 | 837 | 869 | 901 | 933 | 965 | 997 |
| 5 | 5 | 4 | 36 | 68 | 100 | 132 | 164 | 196 | 228 | 260 | 292 | 324 | 356 | 388 | 420 | 452 | 484 | 516 | 548 | 580 | 612 | 644 | 676 | 708 | 740 | 772 | 804 | 836 | 868 | 900 | 932 | 964 | 996 |
| 4 | 4 | 3 | 35 | 67 | 99 | 131 | 163 | 195 | 227 | 259 | 291 | 323 | 355 | 387 | 419 | 451 | 483 | 515 | 547 | 579 | 611 | 643 | 675 | 707 | 739 | 771 | 803 | 835 | 867 | 899 | 931 | 963 | 995 |
| 3 | 3 | 2 | 34 | 66 | 98 | 130 | 162 | 194 | 226 | 258 | 290 | 322 | 354 | 386 | 418 | 450 | 482 | 514 | 546 | 578 | 610 | 642 | 674 | 706 | 738 | 770 | 802 | 834 | 866 | 898 | 930 | 962 | 994 |
| 2 | 2 | 1 | 33 | 65 | 97 | 129 | 161 | 193 | 225 | 257 | 289 | 321 | 353 | 385 | 417 | 449 | 481 | 513 | 545 | 577 | 609 | 641 | 673 | 705 | 737 | 769 | 801 | 833 | 865 | 897 | 929 | 961 | 993 |
| 1 | 1 | 0 | 32 | 64 | 96 | 128 | 160 | 192 | 224 | 256 | 288 | 320 | 352 | 384 | 416 | 448 | 480 | 512 | 544 | 576 | 608 | 640 | 672 | 704 | 736 | 768 | 800 | 832 | 864 | 896 | 928 | 960 | 992 |

20

50c

40

30

RESISTIVE FREQUENCY SELECTIVE SURFACE CIRCUIT FOR REDUCING COUPLING AND ELECTROMAGNETIC INTERFERENCE IN RADAR ANTENNA ARRAYS

GOVERNMENT RIGHTS

This invention was made with U.S. Government support under contract No. W56 HZV-05-C-0724 awarded by the Department of Defense. The U.S. Government has certain rights in this invention.

BACKGROUND

The present invention relates to the field of antennas.

Antenna systems using transmit modules adjacent corresponding receive modules are prone to experience a degree of unwanted coupling and electromagnetic interference, partially resulting from their proximity. Accordingly, coupled and interfering signals between adjacent antenna regions may be a limiting factor in the performance of wireless communication systems, and may therefore negatively impact radar system performance and limit simultaneous transmit/receive operation.

Prior attempts to reduce the effects of unwanted coupling and electromagnetic interference have used resistive cards, also referred to as "R-cards." These R-cards may be placed in layers proximate to the transmit and receive modules of the antenna system, such as near a radome covering the modules. R-card layers, however, may be difficult to place in desired locations without the negative impact of increased radome loss. Furthermore, in addition to increasing loss, R-cards fail to improve perpendicular scan behavior, resulting in degradation of both the average insertion loss and the worst-case insertion loss through the radome. Also, the degradation is greatest where the gain is needed most, e.g., at the extreme scan angle in the scan passband. Although these problems may be addressed by using R-cards of high impedance, such an approach may provide unsatisfactory attenuation per distance.

Prior attempts to reduce the effects of unwanted coupling and electromagnetic interference have included magnetic absorbers of various configurations. However, magnetic absorbers are commonly heavy, and typically do not work well with antenna systems operating in ranges of higher frequencies.

SUMMARY

Embodiments of the present invention aim to reduce the magnitude of unwanted coupling and electromagnetic interference in a radar antenna array by providing selective additional attenuation along a direction in which unwanted coupling and electromagnetic interference are propagating, leading to a more robust performance at the system level.

One aspect of exemplary embodiments of the present invention provides improved system level performance of radar systems (e.g., radar antenna arrays) by reducing interfering signals produced within the system.

Another aspect of exemplary embodiments of the present invention allows optimization in view of frequency and scan requirements of a radar antenna array in order to improve system performance.

In accordance with one exemplary embodiment of the present invention, there is provided an antenna system including a transmit module configured to send a signal, a receive module configured to receive the signal, a radome, and a resistive frequency selective surface circuit configured to reduce a coupled portion of the signal, the resistive frequency selective surface circuit disposed in a path of the coupled portion of the signal.

The resistive frequency selective surface circuit may be tunable.

The antenna system may also include a resistive component coupled to the resistive frequency selective surface circuit.

The resistive frequency selective surface circuit may be configured to operate as a directional filter.

The resistive frequency selective surface circuit may be configured to attenuate a portion of the signal outside a system scan volume, and may be configured to substantially transmit a portion of the signal inside the system scan volume.

A desired portion of the signal may substantially pass through the resistive frequency selective surface circuit, while an interfering portion of the signal may be attenuated by the resistive frequency selective surface circuit.

The resistive frequency selective surface circuit may substantially transmit a portion of the signal at a desired far-field angle coverage of the system.

A portion of the coupled portion of the signal may be significantly attenuated while traveling along the radome or the resistive frequency selective surface circuit.

A pattern of the resistive frequency selective surface circuit may be a tripole pattern, a trifold slot pattern, a Jerusalem cross pattern, and various other configurations and combinations of configurations familiar to those skilled in the art.

The resistive frequency selective surface circuit may include copper or other conductive metal material.

The resistive frequency selective surface circuit may also include a thin film resistor material, such as TICER® brand material produced by Ticer Technologies, LLC, or OMEGA-PLY® brand resistive foil produced by Laminators Incorporated Corporation.

The radome may include quartz-loaded material composites, ceramic-loaded material composites, and/or soft substrate composites, such as ARLON CLTE™ brand material produced by Arlon Inc. and/or DUROID® brand material produced by Rogers Corporation.

The radome may also include thermoplastic material between two layers of the quartz The resistive frequency selective surface circuit may be between one of the two layers of the quartz and the thermoplastic material.

The resistive frequency selective circuit may be substantially within the radome.

The resistive frequency selective circuit may be on a surface of the radome.

The resistive frequency selective circuit may be substantially detached from the radome.

The resistive frequency selective circuit may be substantially parallel to the radome.

In accordance with another exemplary embodiment of the present invention, there is provided a method of reducing unwanted coupling and electromagnetic interference between transmit modules and receive modules of an antenna system including patterning a resistive frequency selective surface circuit corresponding to a frequency range, and placing the resistive frequency selective surface circuit in a position relative to the antenna system to attenuate the unwanted coupling and electromagnetic interference.

The method may further include tuning the resistive frequency selective surface circuit in view of the frequency range and scan requirements of the antenna system.

Accordingly, embodiments of the present invention allow for a resistive frequency selective surface (FSS) circuit that effectively acts as a directional filter for a range of frequencies correlating to an operating bandwidth of a corresponding antenna system. Frequency selective surfaces may be substantially planar and made of metallic elements, and may consist of patterns or repeating geometrical shapes, or may be a simple metallic screen with periodic apertures therein. The electromagnetic properties of frequency selective surfaces, such as their transmission and reflection coefficients, may depend on frequencies of operation, as well as a polarization and/or angle of a transmitted electromagnetic wave contacting the frequency selective surface. For example, a hypothetical FSS may be completely opaque to some frequencies and direction angles, while allowing wave transmission for other frequencies and direction angles. Such characteristics allow the FSS circuit to effectively reduce unwanted coupling and electromagnetic interference caused by adjacent transmit modules and receive modules of an antenna array system, as the unwanted coupling and electromagnetic interference portions of the signal travel, to a large degree, in a single general direction (e.g., along a radome).

BRIEF DESCRIPTION OF THE DRAWINGS

The accompanying drawings, together with the specification, illustrate exemplary embodiments of the present invention, and, together with the description, serve to explain aspects of embodiments of the present invention. The above and other features and aspects of the present invention will become more apparent by describing in detail exemplary embodiments thereof with reference to the attached drawings, in which:

FIG. 1 is a schematic diagram of an antenna array having four quadrants with simultaneous transmit and receive modules;

DETAILED DESCRIPTION

Frequency selective surfaces have been used as a means for blocking or attenuating particular antenna frequencies, enabling frequency shields to prevent electro-magnetic waves of a particular frequency, or range of frequencies, from effectively passing therethrough. Adjacent transmit modules and receive modules of an antenna array may generally experience some degree of coupling or interference, thereby potentially reducing the accuracy or quality of a perceived radar image of an intended target. For example, a signal transmitted by a transmit module, or radiator, of an antenna system may be received by a corresponding receive module, or receiver, of the antenna system despite the signal failing to reach the intended target. This may impact the performance and accuracy of the antenna array system.

Similarly, interference may exist between separate antenna systems in close proximity, whereby the signal transmitted by a transmit module of one system is perceived by a receive module of another system. This interference may also lead to poorer system performance.

Figure 2:
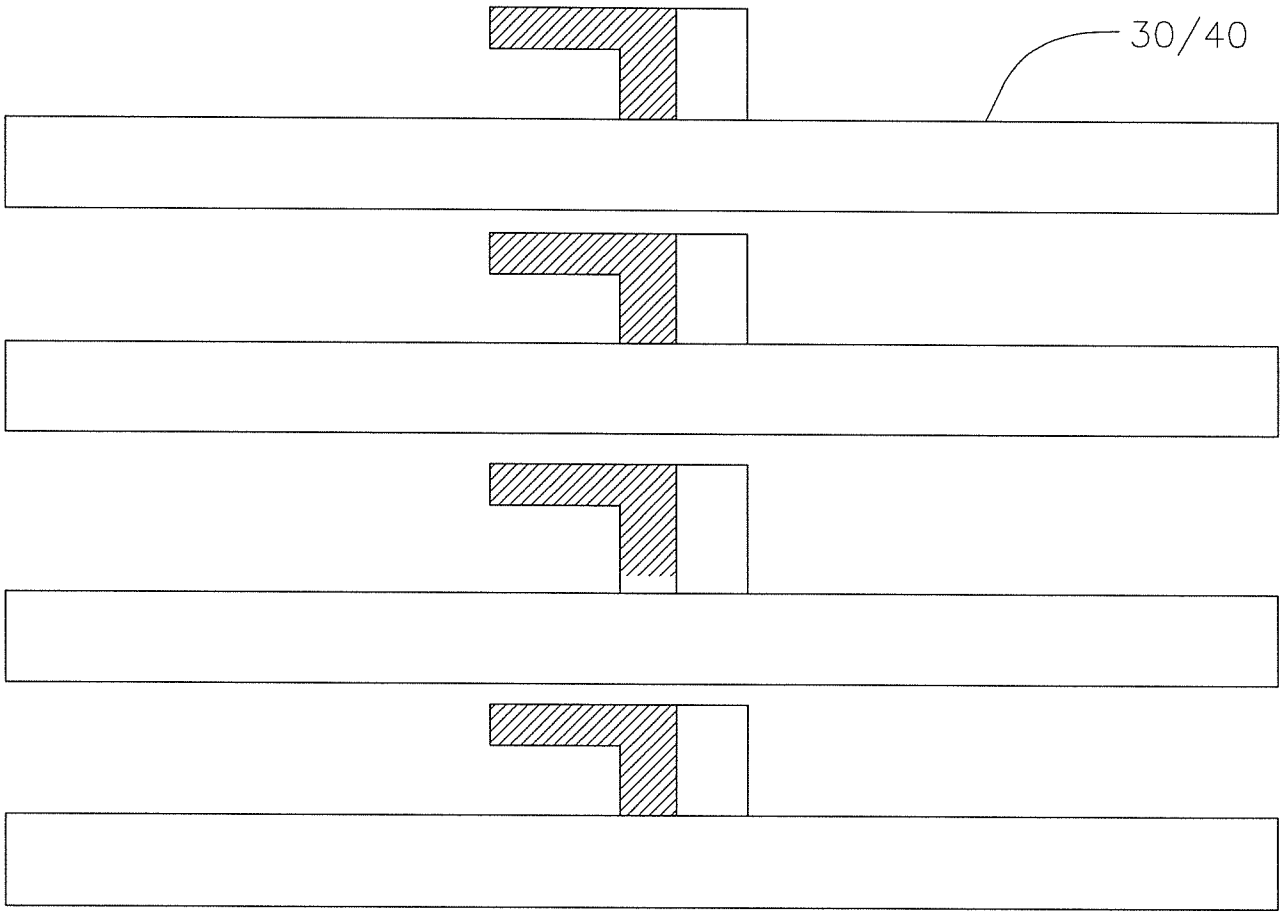
FIG. 2 is a schematic diagram of a plurality of Transmit/Receive Integrated Microwave Modules including transmit modules and receive modules.
Figure 3:
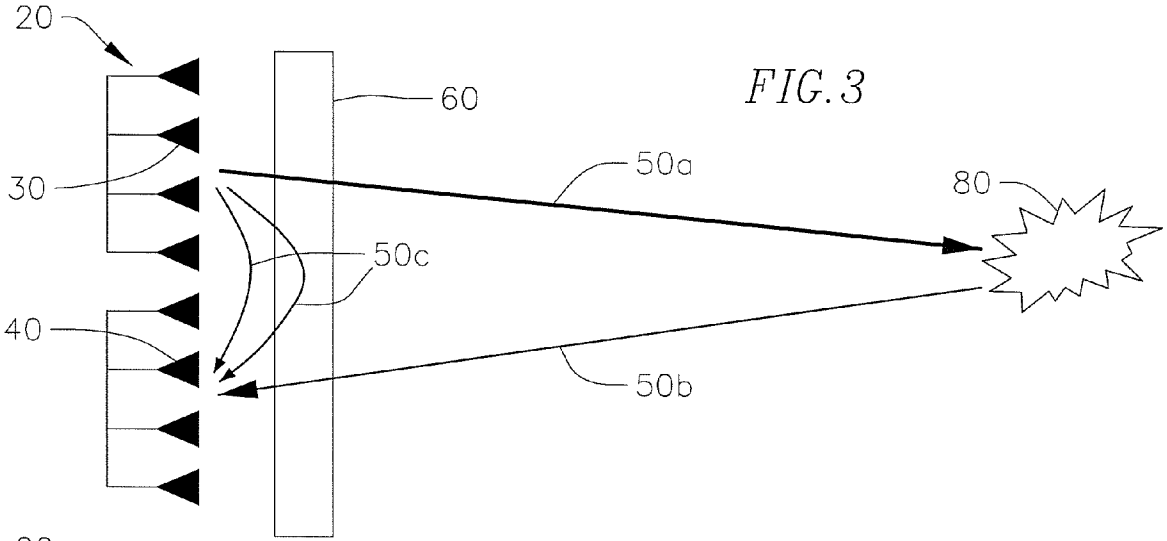
FIG. 3 is a schematic diagram of a plurality of transmit modules of an antenna system transmitting a signal toward an intended target beyond a radome of an antenna system, and a plurality of receive modules of the antenna system receiving the signal.

Referring to FIG. 1, the antenna system 20, which uses transmit modules 30 and receive modules 40 to transmit and receive signals (such as the Transmit/Receive Integrated Microwave Modules 30/40 depicted in FIG. 2), may be prone to experiencing a degree of unwanted coupled energy 50*c* that degrades system performance. As shown in FIG. 3, the unwanted coupled energy 50*c* may be a portion of a transmitted signal 50 that is sent by transmit modules 30 toward a target 80, but fails to reach the target 80 before being received by the receive modules 40. For example, although a successfully transmitted portion 50*a* of the signal 50 may pass through a radome 60 of the antenna system 20 to reach the target 80, thereby enabling receive modules 40 to receive a reflected portion 50*b* of the signal 50 through the radome 60, a portion of the signal 50 representing unwanted coupled energy 50*c* may be transmitted by transmit modules 30 and may then travel directly from the transmit modules 30 to the receive modules 40, or may also be reflected off of, or guided along, the radome 60 toward the receive modules 40. The unwanted coupled energy 50*c* may thereafter be received by the receive module 40 while never having reached the intended target 80, thereby negatively effecting image resolution of the intended target 80.

As shown in FIG. 3, an antenna system 20 including adjacent transmit modules 30 and receive modules 40 directs an antenna signal 50 transmitted by the transmit modules 30 toward an intended target 80 through a radome 60. In doing so, a successfully transmitted portion 50*a* of the antenna signal 50 reaches the intended target 80, which returns a reflected portion 50*b* of the antenna signal 50 back through the radome 60 and to the receive modules 40. However, a portion of the transmitted signal 50 representing a degree of unwanted coupling and electromagnetic interference 50*c* fails to successfully pass through the radome 60, and is returned to the receive modules 40 without reaching the intended target 80, thereby reducing the quality of the image of the intended target 80 perceived by the receive modules 40.

Figure 4:
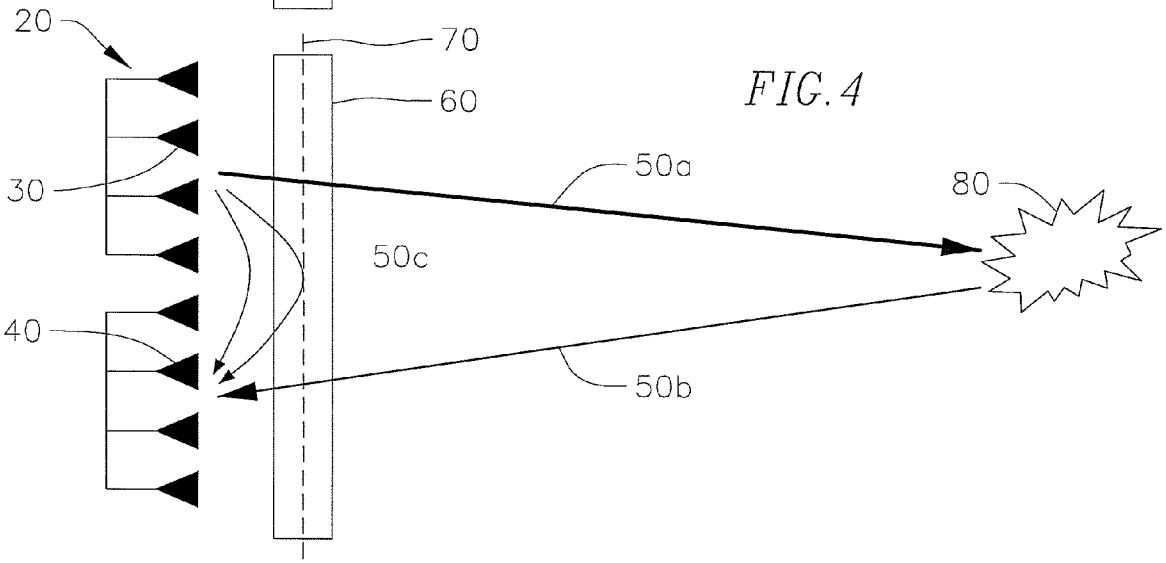
FIG. 4 is a schematic diagram of a plurality of transmit modules of an antenna system transmitting a signal toward an intended target beyond a radome of an antenna system housing a resistive frequency selective surface circuit according to an embodiment of the present invention, and a plurality of receive modules of the antenna system receiving the signal.

By adding a frequency selective surface 70 of an embodiment of the present invention (e.g., so that the FSS circuit 70 is embedded within the radome 60, as shown in FIG. 4), the unwanted coupling and electromagnetic interference portion 50*c* of the antenna signal 50 is further attenuated, thereby improving the corresponding perceived radar image over that of a system not employing a FSS circuit 70 (such as the system of FIG. 3). This may be achieved by designing the FSS circuit 70 to provide low attenuation for portions of the antenna signal 50 traveling in a direction from the antenna system 20 toward the intended target 80, or returning to the antenna system 20 from the intended target 80 (e.g., signals 50*a* and 50*b*), while designing the FSS circuit 70 to provide high attenuation for portions of the antenna signal 50 traveling in a direction along the radome (e.g., signal 50*c*). Although the FSS circuit 70 is depicted as being located approximately at a center of the radome 60, it should be understood that the FSS circuit 70 may be differently located. For example, the FSS circuit 70 may be elsewhere within the radome 60, may be on a surface of the radome 60, or may even be detached from the radome 60. Furthermore, the embodiments of the present invention are not limited to having a radome 60 or FSS circuit 70 at a particular distance from the transmit modules 30 and receive modules 40, although minimizing a distance between the FSS circuit 70 and the transmit/receive modules 30/40 may be desirable for certain embodiments of the present invention. Also, the embodiments of the present invention are not limited to reducing unwanted coupling/electromagnetic interference 50*c* within a single system 20, as the transmit modules 30 and the receive modules 40 that are coupled may belong to separate antenna systems, such as antenna systems in relatively close proximity.

Referring to FIG. 4, embodiments of the present invention provide a resistive frequency selective surface (FSS) circuit 70 on, within, or near a radome 60 of an antenna system 20 (e.g., between the transmit module(s)/receive module(s) 30/40 and the radome 60 or the intended target 80) to reduce unwanted coupling and electromagnetic interference 50*c* by providing additional attenuation for a particular frequency or range of frequencies (e.g., of a signal 50) along a particular direction (e.g., the direction in which the greatest degree of unwanted coupling and electromagnetic interference 50*c* occurs). By providing additional attenuation of a portion of the signal 50 representing the unwanted coupling and electromagnetic interference 50*c*, a guided mode of the coupled wave 50*c* (e.g., the portion 50*c* of the signal 50 that is perceived by the receive modules 40 without having reached the intended target 80) may lose significant energy prior to being received by the receive modules 40, thereby improving a corresponding radar image. The attenuation may be achieved by absorbing the guided energy at the radome 60 housing the FSS circuit 70, while leaving the successfully transmitted portion 50*a* of the signal 50, as well as the reflected portion 50*b* of the signal 50, largely unattenuated. The successfully transmitted portion 50*a* of the signal 50 may be directed through the radome 60 somewhere between boresight and the scan limit.

The FSS circuit 70 of embodiments of the present invention is able to effectively act as a directional filter by allowing signals 50*a*, 50*b* traveling in a particular direction (e.g., far-field scan volume), to freely pass through the pattern formed by the FSS circuit 70 with little interference, while signals 50*c* traveling in another direction (e.g., near field environment) experience a greater degree of resistance caused by the FSS circuit 70. The increased degree of resistance leads to attenuation of the portion of the signal 50 representing the unwanted coupling and electromagnetic interference 50*c*.

Furthermore, the pattern (e.g., the pattern of holes or etchings) of the FSS circuit 70, along with the resistance value of the material or materials of which the FSS circuit 70 is made, may influence or determine the direction and the range of frequencies of signals 50 that are able to pass through the FSS circuit 70, as well as the direction and the range of frequencies of signals 50 that experience a higher degree of attenuation due to the FSS circuit 70.

Figure 5:
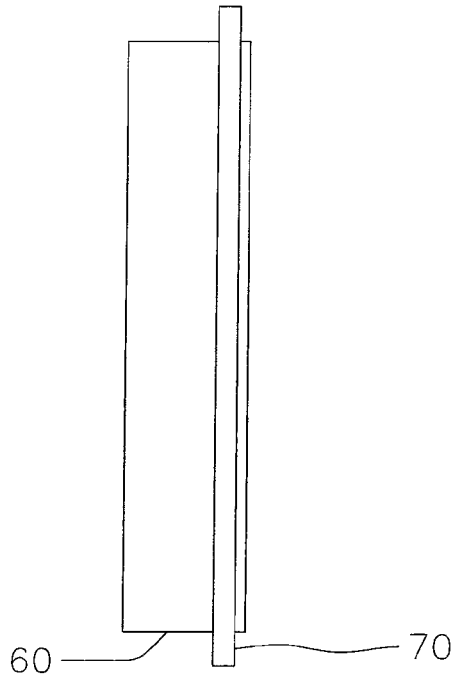
FIG. 5 is a cross-sectional view of a radome of an antenna system housing a resistive frequency selective surface circuit according to an embodiment of the present invention.

Referring to FIG. 5, one embodiment of the present invention may include a FSS circuit 70 located near an inner surface of a radome 60 in which it is embedded. Furthermore, other embodiments of the present invention may include a FSS circuit 70 located on an outer surface of a radome 60. Further still, it should also be understood that more than one FSS circuit 70 may be used in other embodiments of the present invention, with multiple FSS circuits 70 located on an inner surface of a radome 60, on an outer surface of the radome 60, at various points within the radome 60, and/or various points at a distance from the radome 60.

Figure 6:
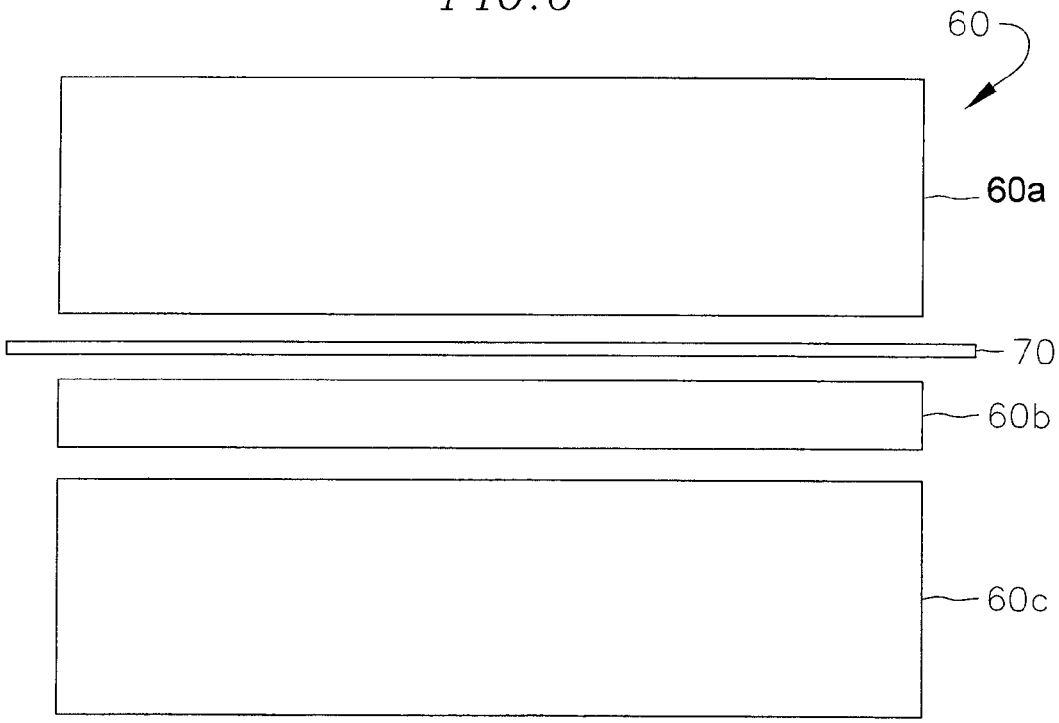
FIG. 6 is an exploded cross-sectional view of a radome of an antenna system housing a resistive frequency selective surface circuit according to an embodiment of the present invention.

Referring to FIG. 6, an embodiment of the present invention provides a radome 60 including selected radome 60 materials stacked together with a FSS circuit 70 for improved performance. For example, outer layers 60*a* and 60*c* of a radome 60 may be made of CE/Quartz having a relative static permissivity/dielectric constant, $\in_r$, equal to approximately 3.1, the layers 60*a* and 60*c* each being approximately 0.055 inches thick, while an inner layer 60*b* of the radome 60 may be made of a thermoplastic material, such as CUCLAD® 6250 material, manufactured by Arlon, Inc., having a relative static permissivity/dielectric constant $\in_r$ equal to approximately 2.32 and having an approximate thickness of 0.0015 inches is interposed between the outer layers 60*a* and 60*c*, and with the FSS circuit 70 between the inner layer 60*b* and one of the outer layers 60*a* and 60*c*. It should be understood that the above values and materials are provided as examples, and that embodiments of the present invention may include different arrangements and/or materials exhibiting different physical properties corresponding to different associated values, such as quartz-loaded material composites, ceramic-loaded material composites, and/or soft substrate composites, such as ARLON CLTE™ brand material, manufactured by Arlon, Inc. and/or DUROID® material, manufactured by Rogers Corporation.

Embodiments of the present invention also allow for the placement of a resistive FSS circuit 70 for attenuating unwanted coupling and electromagnetic interference 50*c* in a desired location of the antenna system 20, thereby minimizing or reducing unwanted effects to the antenna system 20. The resistive FSS circuit 70 passes most energy of the signal 50 at the desired far-field angle coverage of the system (e.g., 50*a*, 50*b*), yet attenuates unwanted coupling (e.g., 50*c*) of the signal 50, which may take the form of energy traveling along a surface of a radome 60 (e.g., attenuates "near grazing," or attenuates coupled energy propagating along the radome as a guided wave). Because of the conductive properties of the FSS circuit 70, the FSS circuit 70 causes signals 50*c* that may otherwise reflect from the radome 60 back to the receive modules 40 of the antenna system 20 to be attenuated in a guided manner along the FSS circuit 70, while traveling a significant distance along, or within, the radome 60. These signals 50*c* experience a higher degree of resistance to propagation than they otherwise would in the absence of the FSS circuit 70. Accordingly, these signals 50*c* are attenuated as a result of the increased resistance resulting from the FSS circuit 70, while signals 50*a*, 50*b* traveling at angles approximately incident to the FSS circuit 70, and therefore, to the radome 60, experience a relatively small degree of resistance, and therefore little attenuation. Furthermore, the resistive FSS circuit 70 may be optimized, or tunable (e.g., may have physical properties that may be user-adjusted), to improve the overall scan angle performance of the antenna system 20.

Methods of tuning a frequency selective surface are described in more detail in U.S. Pat. No. 7,612,718 B2, titled "Tunable Frequency Selective Surface," the entire contents of which are incorporated herein by reference.

Furthermore, in designing a FSS circuit of an embodiment of the present invention, simulations or other testing of one or more patterns of a FSS circuit may be useful for optimizing the FSS circuit in consideration of various system characteristics (e.g., frequency band, scan volume, etc.). For example, the parameters of a proposed FSS circuit, including a pattern of the FSS circuit, may be tested in a virtual setting, such as by HIGH FREQUENCY STRUCTURE SIMULATOR software developed by Ansoft Corporation of Pittsburgh, Pa. However, other electromagnetic analysis tools and/or laboratory experiments may be used in the design process.

Also, a number of design considerations, which will be known to one skilled in the art, may factor into the design of a FSS circuit and/or antenna system of an embodiment of the present invention. For example, in seeking to develop a FSS circuit having high attenuation in a direction of a near field environment, it may be advantageous to develop a pattern having numerous slots that are closely packed or tightly spaced. By having numerous, tightly coupled slots, a signal experiences a relatively low degree of attenuation over a broad scan volume and/or frequency bandwidth, enabling the signal to pass through these slots. However, signals traveling in a direction of a relatively acute angle with respect to the FSS circuit are attenuated to a greater degree. Because such acute angles may be associated with the unwanted coupling mentioned above, slot patterns appear to be one effective approach to designing the FSS circuit, although the present invention is not limited thereto.

Other considerations in developing a pattern of a FSS circuit may be, for example, the shape, area, and perimeter length of pattern elements or of etched portions that define the pattern of the FSS circuit. Furthermore, in designing a location of a FSS circuit relative to an antenna system, one may seek to position the FSS circuit more closely to the regions of the antenna system experiencing the greatest degree of unwanted coupling. Further still, a FSS circuit having a number of patterns may be used with, for example, antenna systems operating in a range of frequencies, as different patterns may differently effect signals of different frequencies. Other design considerations, such as the size of the slots and the spacing of the slots, may depend on other factors, such as the frequency at which the antenna system operates, and will be determinable by those skilled in the art without undue experimentation.

Figure 7:
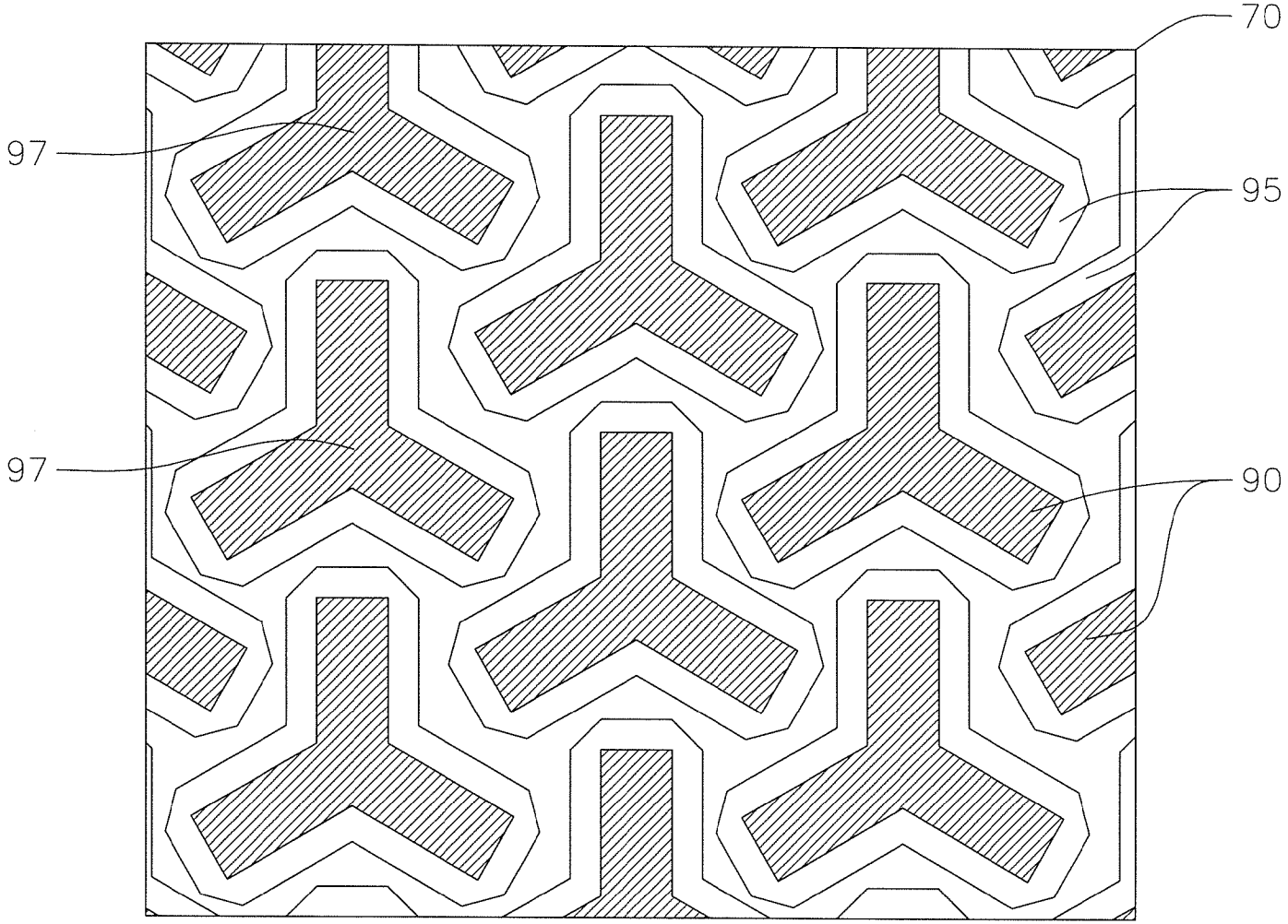
FIG. 7 is a perspective view depicting a pattern of a resistive frequency selective surface circuit according to an embodiment of the present invention.

Referring to FIG. 7, a pattern of a FSS circuit 70 of an embodiment of the present invention is shown. According to the present embodiment, the FSS circuit 70 has a pattern including various equally sized and shaped trifold slots 90. However, it should be understood that a FSS circuit of other embodiments may have various other patterns, such as the Jerusalem cross pattern, which would be know to a person of skill in the art. The pattern of the FSS circuit 70 may be formed by etching a sheet made of a single (e.g., homogenous) material, such as copper. The dimensions of the pattern may include, although the present invention is not limited thereto, centers of adjacent columns of the trifold slots 90 being laterally spaced (e.g., in a left to right direction) by approximately 0.0525 inches, with a width of individual gaps 95 in the pattern being 0.0040 inches or more. Furthermore, centers 97 of adjacent trifold slots 90 in a common column of trifold slots 90 may be spaced approximately 0.061 inches from one another, and the material of the FSS circuit 70 may have a resistance value in the range of approximately 0-5 Ω/square (e.g., approximately 2 Ω/square). However, it should be understood that numerous other patterns and arrangements of the FSS circuit 70 may be practiced without departing from the scope and spirit of the present invention.

Figure 8:
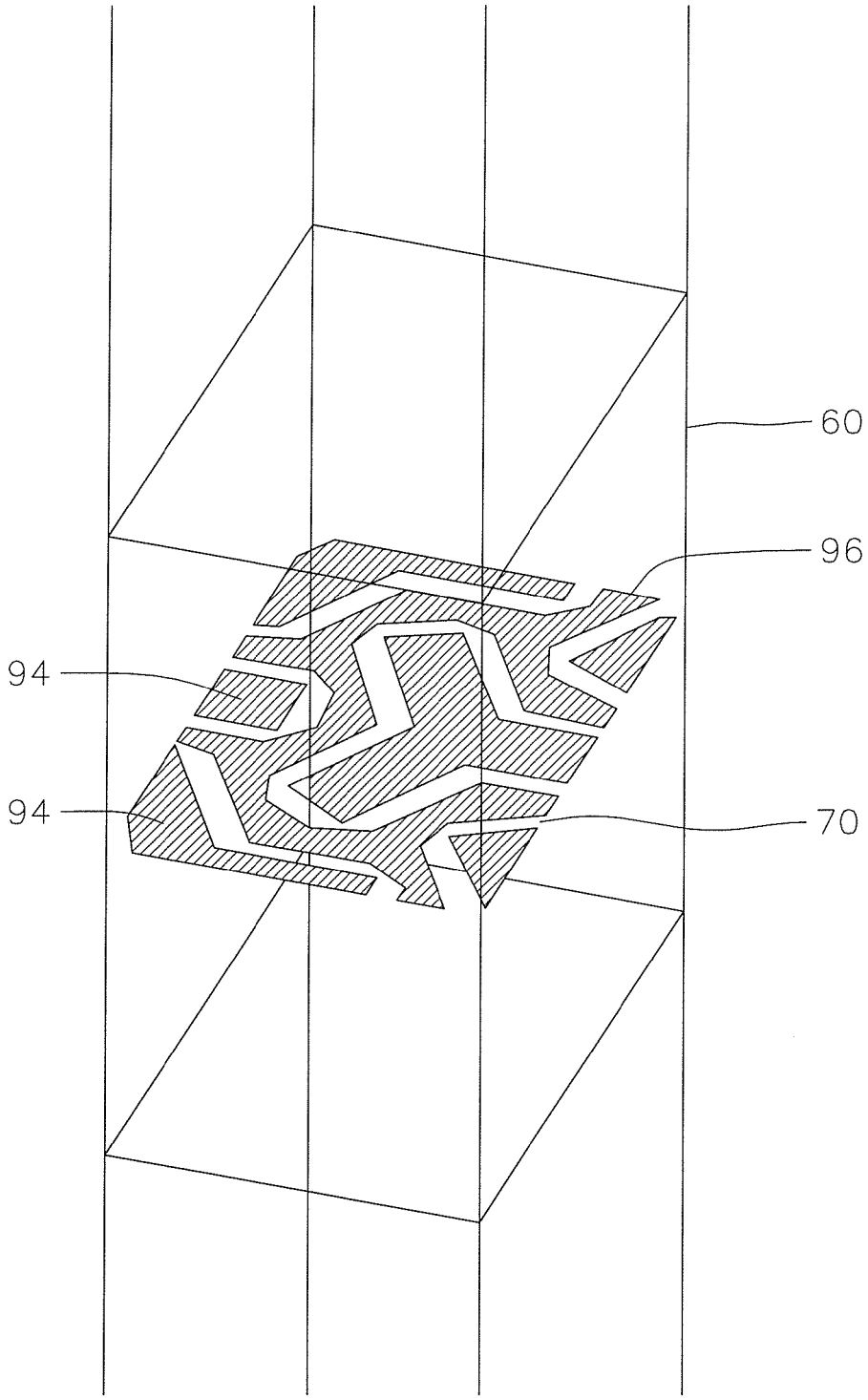
FIG. 8 is a perspective view of a radome of an antenna system housing a resistive frequency selective surface circuit according to an embodiment of the present invention.

For example, and referring to FIG. 8, the FSS circuit 70 may consist of two or more different materials, such as copper and a thin film resistor material (e.g., TICER TECHNOLOGIES® brand thin film resistor material, produced by Ticer Technologies, LLC, or OMEGA-PLY® brand resistive foil, produced by Laminators Incorporated Corporation). In the embodiment shown in FIG. 8, a trifold slot pattern of the FSS circuit 70 similar to that of the embodiment shown in FIG. 7 is used. However, the "island" areas 94 of the trifold slot pattern may be made of a thin film resistor material having a sheet resistance of approximately 2Ω/□ (2 ohms per square), while outer areas 96 surrounding the "island" areas 94 are made of copper. However, various other materials and designs of the FSS circuit 70 may be used without departing from the scope and spirit of the present invention.

In another embodiment of the present invention, one or more additional resistive components may be added to the FSS circuit 70, allowing the FSS circuit 70 to act as a directional filter that passes energy inside the system scan volume (e.g., the frequency range of the antenna system 20) and that attenuates energy outside the system scan volume, allowing the desired signal 50*a*, 50*b* to pass through, while the interfering signal 50*c* is rapidly attenuated, thereby improving system performance.

Accordingly, benefit may be realized where the unwanted coupling 50*c* is reduced dramatically, while the gain of the radome 60 is reduced by only a minor, or minimal, amount (e.g., the energy loss due to the radome 60 is minimally increased). Furthermore, because of the improved performance of the FSS circuit 70 at far scan angles, there may be improvement at such far scan angles corresponding to perpendicular polarization.

While the present invention has been particularly shown and described with reference to exemplary embodiments thereof, it will be understood by those of ordinary skill in the art that features of different embodiments may be combined to form further embodiments, and that various changes in form and details may be made therein, without departing from the spirit and scope of the present invention as defined by the following claims and their equivalents.

What is claimed is:

1. An antenna system comprising:

a transmit module configured to send a signal;

a receive module configured to receive the signal;

a radome; and a resistive frequency selective surface circuit configured to reduce a coupled portion of the signal that is emitted by the transmit module and received by the receive module without passing through the radome, the resistive frequency selective surface circuit disposed in a path of the coupled portion of the signal.

2. The antenna system of claim 1, wherein the resistive frequency selective surface circuit is tunable.

3. The antenna system of claim 1, further comprising a resistive component coupled to the resistive frequency selective surface circuit.

4. The antenna system of claim 1, wherein the resistive frequency selective surface circuit is configured to operate as a directional filter.

5. The antenna system of claim 1, wherein the resistive frequency selective surface circuit is configured to attenuate a first portion of the signal outside a system scan volume, and is configured to substantially transmit a second portion of the signal inside the system scan volume.

6. The antenna system of claim 1, wherein a desired portion of the signal substantially passes through the resistive frequency selective surface circuit, while an interfering portion of the signal is attenuated by the resistive frequency selective surface circuit.

7. The antenna system of claim 1, wherein the resistive frequency selective surface circuit substantially transmits a portion of the signal at a desired far-field angle coverage of the system.

8. The antenna system of claim 1, wherein a portion of the coupled portion of the signal travels along the radome or the resistive frequency selective surface circuit.

9. The antenna system of claim 1, wherein a pattern of the resistive frequency selective surface circuit comprises one of a tripole pattern, a trifold slot pattern, a Jerusalem cross pattern, or any combination of a tripole pattern, a trifold slot pattern, and a Jerusalem cross pattern.

10. The antenna system of claim 1, wherein the resistive frequency selective surface circuit comprises conductive metal material.

11. The antenna system of claim 1, wherein the resistive frequency selective circuit is on a surface of the radome.

12. The antenna system of claim 1, wherein the resistive frequency selective circuit is substantially detached from the radome.

13. The antenna system of claim 1, wherein the resistive frequency selective circuit is substantially parallel to the radome.

14. The antenna system of claim 1, wherein the resistive frequency selective surface circuit is further configured to reduce a portion of the signal sent by the transmit module and received by a second receive module of a separate antenna system.

15. An antenna system comprising:

a transmit module configured to send a signal;

a receive module configured to receive the signal;

a radome; and a resistive frequency selective surface circuit configured to reduce a coupled portion of the signal, the resistive frequency selective surface circuit disposed in a path of the coupled portion of the signal, wherein the resistive frequency selective surface circuit comprises one of a thin film resistor material, resistive foil, or a combination of thin film resistor material and resistive foil.

16. An antenna system comprising:

a transmit module configured to send a signal;

a receive module configured to receive the signal;

a radome; and a resistive frequency selective surface circuit configured to reduce a coupled portion of the signal, the resistive frequency selective surface circuit disposed in a path of the coupled portion of the signal, wherein the radome comprises quartz, a quartz-loaded material composite, a ceramic-loaded material composite, a soft substrate composite, or a combination thereof.

17. The antenna system of claim 16, wherein the radome further comprises thermoplastic material between two layers of the quartz.

18. The antenna system of claim 17, wherein the resistive frequency selective surface circuit is between one of the two layers of the quartz and the thermoplastic material.

19. An antenna system comprising:

a transmit module configured to send a signal;

a receive module configured to receive the signal;

a radome; and a resistive frequency selective surface circuit configured to reduce a coupled portion of the signal, the resistive frequency selective surface circuit disposed in a path of the coupled portion of the signal, wherein the resistive frequency selective circuit is substantially within the radome.

20. A method of reducing unwanted coupling and electromagnetic interference between transmit modules and receive modules of an antenna system, the method comprising:

selecting a patterned resistive frequency selective surface circuit corresponding to a frequency range; and placing the resistive frequency selective surface circuit in a position relative to the antenna system to attenuate the unwanted coupling and electromagnetic interference by absorbing a portion thereof.

21. The method of claim 20, further comprising tuning the resistive frequency selective surface circuit in view of the frequency range and scan requirements of the antenna system.

* * * * *